United States Patent [19]

Cheng

[11] Patent Number: 4,998,629

[45] Date of Patent: Mar. 12, 1991

[54] DISPLAY AND STORAGE RACK

[75] Inventor: Se L. Cheng, Duarte, Calif.

[73] Assignee: Alltrade, Inc., Commerce, Calif.

[21] Appl. No.: 363,162

[22] Filed: Jun. 8, 1989

[51] Int. Cl.[5] ..... A47G 29/00

[52] U.S. Cl. ..... 211/71; 211/74

[58] Field of Search ..... 211/71, 74, 84, 76, 211/88, 70.6, 189, 126, 13; 40/16.2; 312/234.4

[56] References Cited

U.S. PATENT DOCUMENTS

| | | | |
|---|---|---|---|
| 372,352 | 11/1887 | Bailey | 211/71 |
| 493,896 | 3/1893 | Pierce | 211/71 X |
| 877,064 | 1/1908 | Edsell | 211/74 X |
| 1,716,032 | 6/1929 | Daugherty | 211/71 X |
| 1,959,001 | 5/1934 | Kasten | 211/71 |
| 2,035,935 | 3/1936 | Allen | 211/71 |

*Primary Examiner*—Sarah A. Lechok

*Attorney, Agent, or Firm*—Edgar W. Averill, Jr.

[57] ABSTRACT

A display and storage rack for showing, holding and permitting customers to withdraw stored items. The rack has rows of hollow tubes supported at a slight angle from the horizontal. The front of the tubes are open to permit customers, or other users, to withdraw items stored within the tubes. A barrier display strip is held at the base of each tube and covers only a small amount of the front opening. The display strip may be used to hold a sample of the item stored in the tube and, preferably, the display strip is covered with a transparent channel.

9 Claims, 2 Drawing Sheets

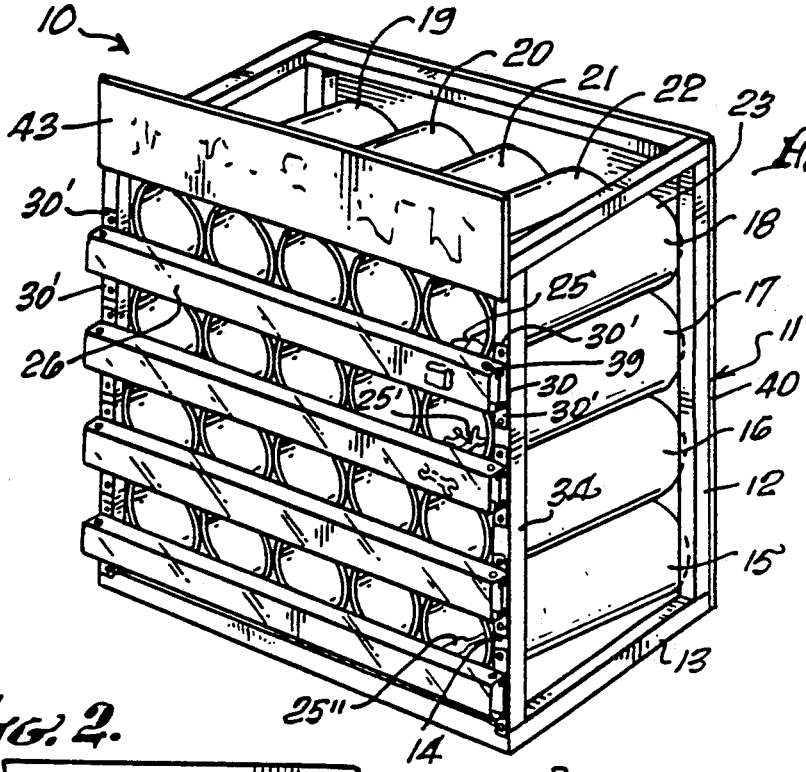
Fig. 1.
Fig. 2.
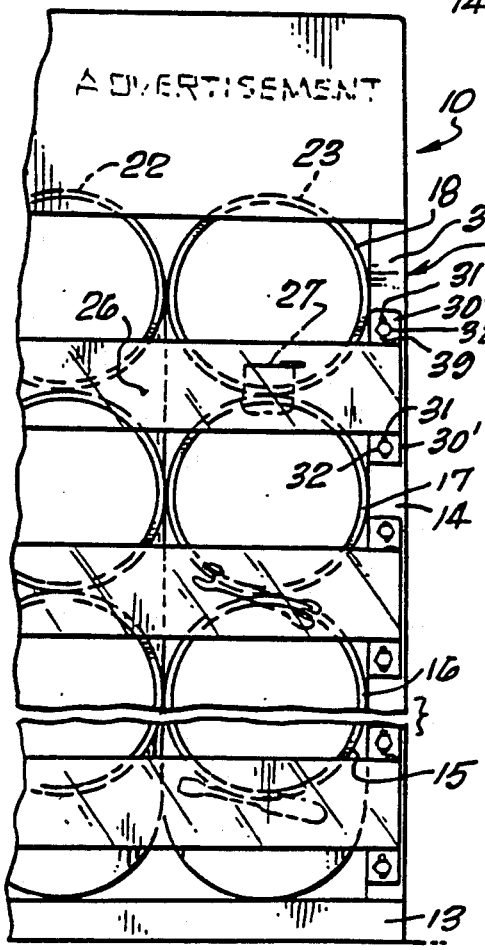
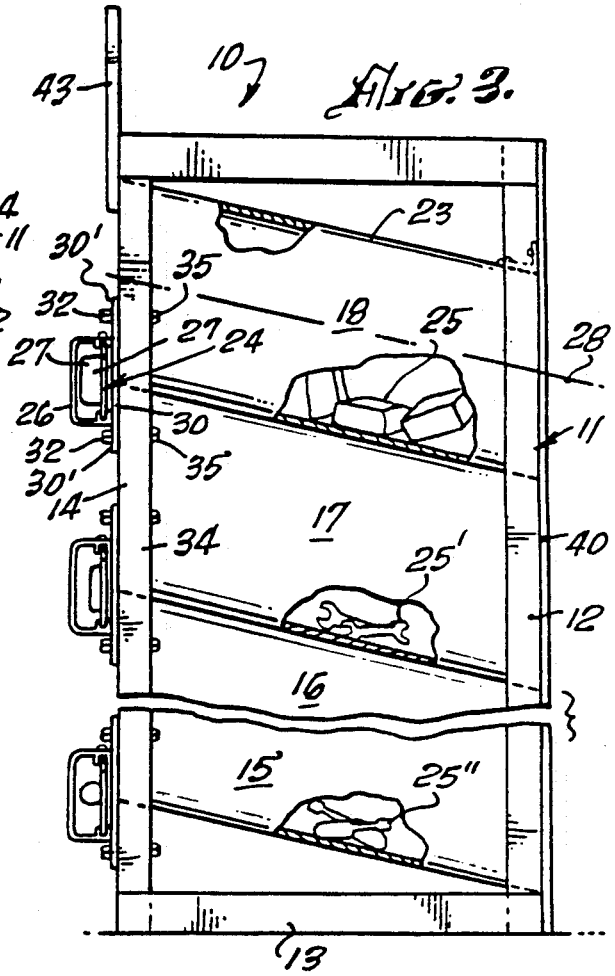
Fig. 3.

39
30'
14
37
26
24
30
27
32
31
39'
33
35
38
15
41
42
34

DISPLAY AND STORAGE RACK

BACKGROUND OF THE DISCLOSURE

The field of the invention is storage containers, and the invention relates more particularly to display and storage racks of the type commonly used in retail stores.

With increased competition, retail stores continue to make it easier for the customer to find items without the need of inquiring from a clerk. One approach to this problem is to package the goods in a highly graphic container so that the customer can see the item and understand it from looking at the side of the box. This approach, however, is not practical for many small items, and items such as tools, for instance open ended wrenches as a typical example. It would be impractical and greatly increase the expense of such products to package them in a manner that the tool could be seen by a picture on the box. Hanging such tools on a rack displays them properly but requires substantial servicing of the rack since typically the hanging area holds only a small number of tools. While metal shelving is commonly used to display hardware items, such shelving is expensive, very heavy and paint thereon is easily chipped or damaged. A light-weight display rack has far more flexibility and may be moved and placed depending upon the season of the year or other marketing considerations.

Numerous storage racks have been designed utilizing tubular, rectangular and other elongated storage elements. Examples of such devices may be found in U.S. Pat. Nos. 3,502,227; 4,099,626; 4,179,033 and 4,433,803. None of these devices, however, are satisfactory for the storage and display of items for resale at retail such as tools.

SUMMARY OF THE INVENTION

It is an object of the present invention to provide an efficient display and storage rack which facilitates the selection of tools or other such objects by a consumer or other user.

The present invention is for a display and storage rack showing, holding and permitting customers to withdraw stored items. The rack has a frame having a base, a front and a back. At least one row of hollow tubes is held by the frame, and each of the tubes has an open front and a closed rear. The longitudinal axis of each of the tubes is supported at an angle of between 10° and 45° with respect to the horizontal. A barrier and display strip is supported along the front of each of the hollow tubes, and the strip extends horizontally and upwardly from the bottom portion of each open front so as to cover at least 10 and no more than 50 percent of the open front. Preferably, the tubes are cut at an angle so that they form a vertical front and back. Also, preferably, the display rack is covered with a transparent channel so that the customer can easily see all details of the tools or other objects stored within each tube.

BRIEF DESCRIPTION OF THE DRAWINGS

FIG. 1 is a perspective view of the display and storage rack of the present invention.

FIG. 2 is an enlarged front view of a portion of the display rack of FIG. 1.

FIG. 3 is a side view thereof.

DESCRIPTION OF THE PREFERRED EMBODIMENTS

Figures 4, 5, 6, 7, 8:
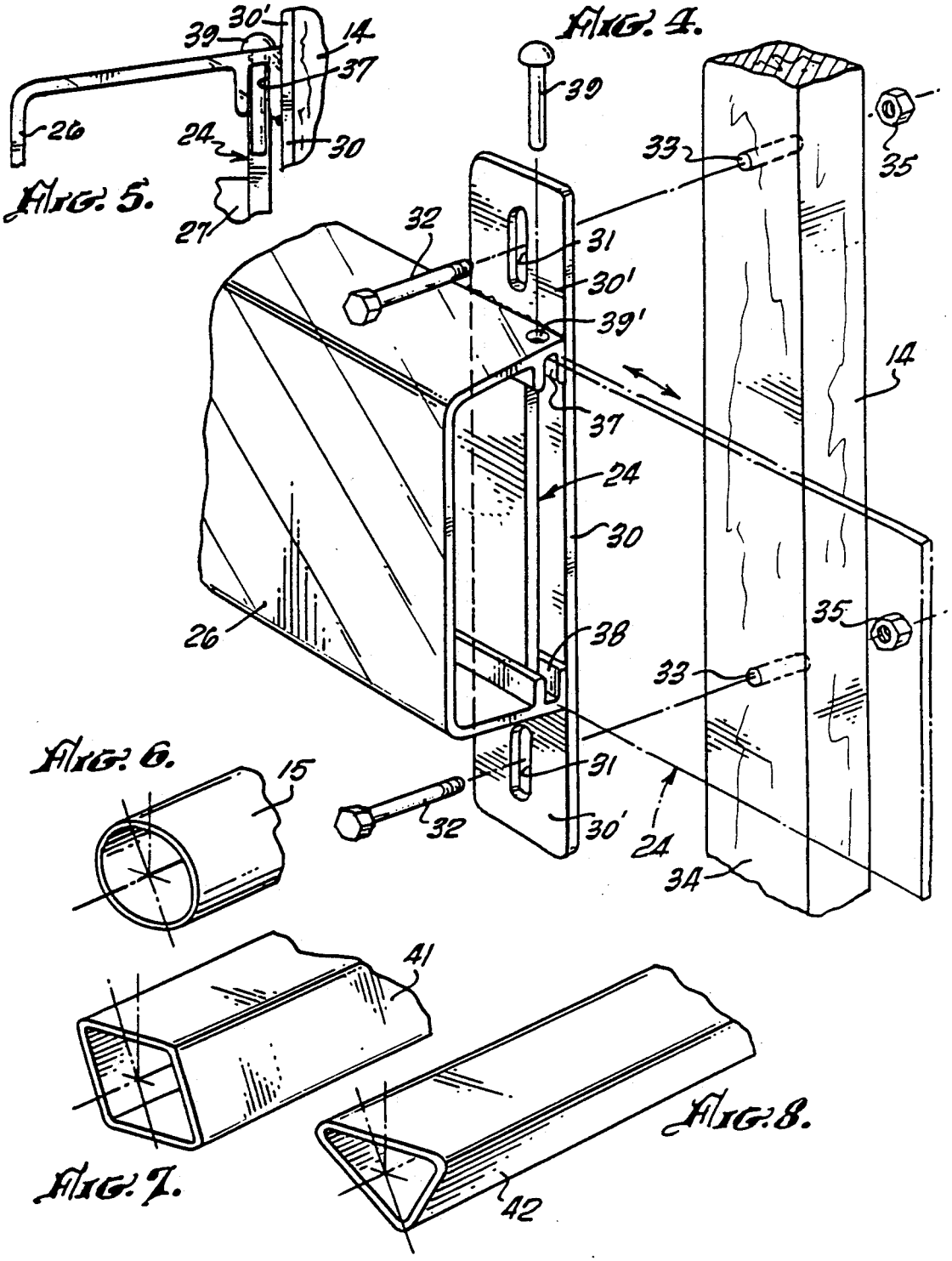
FIG. 4 is an exploded perspective view partially cut away of the transparent display channel of the rack of FIG. 1.
FIG. 5 is an enlarged upper end view of the display rack of FIG. 4.
FIG. 6 is a perspective view of a cylindrical tube cut at an angle with respect to the longitudinal axis of the tube.
FIG. 7 is a perspective view showing the front of a square tube cut at an angle with respect to its longitudinal axis.
FIG. 8 is a perspective view showing the front of a triangular tube cut at an angle with respect to its longitudinal axis.

The display and storage rack of the present invention is shown in perspective view in FIG. 1 and indicated by reference character 10. Rack 10 has a frame 11 which includes a back 12, a base 13 and a front 14. Rack 10 has four horizontal rows of cylindrical tubes indicated by reference characters 15, 16, 17 and 18. These four rows of tubes are positioned in five columns, namely, 19, 20, 21, 22 and 23. Row 18 is supported by a barrier and display strip 24. This performs two functions, namely, the display of tools or other objects within the barrels indicated by reference character 25. One of the tools is placed in a transparent channel 26, and a display tool is indicated by reference character 27. It can be seen that a large variety of objects may be stored in the rack 10, more specifically, up to twenty in a relatively small space. By fabricating the tubes from fiberboard, the rack is both durable, of light weight and economical to fabricate. Also, it is easy for a consumer to reach into a barrel and select a tool which will be the same as the tool displayed in the transparent channel 26. Furthermore, an advertising copy display board 43 may be used to promote sale of the items.

As shown in FIG. 3, the tubes are mounted at an angle with respect to the horizontal. For instance, the barrel that is in row 18 and column 23 is shown partially cut away and has a longitudinal axis 28. This longitudinal axis is at an angle of about 15° with respect to the horizontal. This permits the barrel to be filled to more than half its volume, and the barrier and display strip 24 prevents the spilling out of tools when the barrel is at its maximum capacity. The angle of the tubes with respect to the horizontal should be between 10° and 45°, and 15° has been found to be an ideal angle for retail storage and display. Another economy is obtained by using a single backboard 40 to close the back of all of the tubes. In this way, the display and storage rack 10 may be fabricated with a minimum of cost.

The displaying of tools is indicated best in FIG. 2 where it can be seen that tape measures 25 are held in the upper right-hand barrel, open ended wrenches 25' in the barrel below and screwdrivers 25'' in the barrel 15 below that. The price can also be easily displayed on the barrier display strip 24.

The details of construction of the barrier and display strip are shown best in FIGS. 4 and 5. There it can be seen that a mounting bracket 30 has extensions 30' and is affixed by an adhesive or otherwise transparent channel 26. Bucket 30 has a pair of slots 31 where hex head screws 32 may be inserted through a holes 33 in frame member 34. Nuts 35 secure the screws and bracket 30 to the frame member. A pair of channels 37 and 38 guide the barrier and display strip 24 into the transparent channel 26. A retaining pin 39 is dropped in hole 39' and retains the barrier and display strip 24 in place. When it is necessary to change the articles within one of the containers, retaining pin 39 is removed and strip 24 is withdrawn sufficiently to permit the changing of the tool and/or the price. The tool may be wired, adhered with adhesive or otherwise affixed to strip 24, but the method of affixing should be removable so that the inventory may be updated.

Although cylindrical tubes are shown in FIGS. 1 through 3, other shapes of tubes can also be used and they, too, should be cut at an angle of between 10° and 45° so that their front and rear surfaces are vertical. For instance, a square tube 41 is shown in FIG. 7 and a triangular tube 42 is shown in FIG. 8.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A display and storage rack for showing, holding, and permitting the withdrawal of stored items, said rack comprising:

a frame having a base, a front and a back, said frame being supported on a horizontal floor;

at least one row of hollow tubes held by said frame, each of said tubes having an open front, a closed rear and a longitudinal axis, each of said tubes being supported at an angle between 10 and 45 degrees with respect to the horizontal floor, wherein the front and rear of each tube is cut so that it is vertical and in the same vertical plane relative to the horizontal floor as every other tube, and the rear is closed by a single sheet of material secured to the back of said frame;

a barrier and display strip supported along the front of each of the hollow tubes, said strip extending horizontally and extending upwardly from the lower most portion of each open front so as to cover at least ten and no more than fifty percent of said open front.

2. The display and storage rack of claim 1 wherein said tubes are cylindrical tubes.

3. The display and storage rack of claim 2 wherein there are a plurality of rows of tubes.

4. The display and storage rack of claim 3 wherein said rows are aligned both horizontally and vertically.

5. The display and storage rack of claim 2 wherein said tubes are mounted at an angle of about 15° with respect to the horizontal.

6. A display and storage rack for showing, holding, and permitting the withdrawal of stored items, said rack comprising:

a frame having a base, a front and a back, said frame being supported on a horizontal floor;

at least one row of hollow tubes held by said frame, each of said tubes having an open front, a closed rear and a longitudinal axis, each of said tubes being supported at an angle between 10 and 45 degrees with respect to the horizontal; and wherein the front and rear of each tube is cut so that it is vertical and in the same vertical plane relative to the horizontal floor as every other tube, and the rear is closed by a single sheet of material secured to the back of said frame; and a barrier and display strip supported along the front of each of the hollow tubes, said strip extending horizontally and extending upwardly from the lowermost portion of each open front so as to cover at least ten and no more than fifty percent of said open front, said barrier and display strip including a transparent channel affixed thereto so that an individual tool or other unit of the objects being stored and any pricing indicia can be displayed adjacent the tube in which they are stored.

7. The display and storage rack of claim 6 wherein said transparent channel includes slot means for holding an elongated object display board.

8. The display and storage rack of claim 6 wherein the rear of each tube is closed by a rear wall held by the back of the frame.

9. The display and storage rack of claim 6 wherein said tubes are fabricated from fiberboard.

* * * * *